US011014133B2

(12) United States Patent
Seidel

(10) Patent No.: US 11,014,133 B2
(45) Date of Patent: May 25, 2021

(54) DEVICE AND METHOD FOR APPLYING A LIQUID MEDIUM TO A ROLL AND/OR TO A ROLLED MATERIAL AND/OR FOR REMOVING THE LIQUID MEDIUM

(71) Applicant: SMS GROUP GMBH, Düsseldorf (DE)

(72) Inventor: Jürgen Seidel, Kreuztal (DE)

(73) Assignee: SMS GROUP GMBH, Düsseldorf (DE)

( * ) Notice: Subject to any disclaimer, the term of this patent is extended or adjusted under 35 U.S.C. 154(b) by 45 days.

(21) Appl. No.: 16/329,322

(22) PCT Filed: Aug. 22, 2017

(86) PCT No.: PCT/EP2017/071157
§ 371 (c)(1),
(2) Date: Feb. 28, 2019

(87) PCT Pub. No.: WO2018/046295
PCT Pub. Date: Mar. 15, 2018

(65) Prior Publication Data

US 2019/0247901 A1 Aug. 15, 2019

(30) Foreign Application Priority Data

Sep. 6, 2016 (DE) ..... 10 2016 216 865.7
Nov. 23, 2016 (DE) ..... 10 2016 223 131.6

(51) Int. Cl.
*B21B 27/10* (2006.01)
*B21B 45/02* (2006.01)
*B21B 45/08* (2006.01)

(52) U.S. Cl.
CPC ..... *B21B 27/10* (2013.01); *B21B 45/0218* (2013.01); *B21B 45/0281* (2013.01); *B21B 45/08* (2013.01); *B21B 2027/103* (2013.01)

(58) Field of Classification Search
CPC ..... B21B 27/10; B21B 2027/103; B21B 45/0218; B21B 45/0278; B21B 45/0281; B21B 45/0284; B21B 45/0233
(Continued)

(56) References Cited

U.S. PATENT DOCUMENTS 4,644,774 A * 2/1987 van Steden ..... B21B 27/10 72/201
5,001,915 A * 3/1991 Blazevic ..... B21B 39/16 29/401.1
(Continued)

FOREIGN PATENT DOCUMENTS

CN 202052763 U 11/2011
DE 4422422 A1 7/1995
(Continued)

OTHER PUBLICATIONS

Mitsunori, Translation of JPH06339712-A (Year: 1994).*

*Primary Examiner* — Adam J Eiseman
*Assistant Examiner* — Bobby Yeonjin Kim
(74) *Attorney, Agent, or Firm* — Lucas & Mercanti, LLP; Klaus P. Stoffel

(57) ABSTRACT

A device and a method for applying a liquid medium to a roll, and/or to a rolled material, a slab or a roughed strip and/or for removing the liquid medium, wherein the device has at least one spray nozzle, at least one row of spray nozzles or at least one cooling bar for spraying on the medium and at least one plate element, which is designed for collecting the medium. The roll is designed for rolling rolled material, wherein the rolled material, the slab or the roughed strip is conveyed in a conveying direction. In order to allow an improved cooling effect of a roll to be cooled or an improved removal of descaling water, the plate element has on one of its surfaces at least one directing element, which
(Continued)

is designed for diverting medium into a transverse direction, which lies horizontally and transversely in relation to the conveying direction.

13 Claims, 5 Drawing Sheets

(58) Field of Classification Search
USPC ..... 72/202, 236
See application file for complete search history.

(56) References Cited

U.S. PATENT DOCUMENTS

| | | | | |
|---|---|---|---|---|
| 5,628,223 | A | 5/1997 | Denker | |
| 6,006,574 | A | 12/1999 | Armenat | |
| 6,385,989 | B1 * | 5/2002 | Cassidy | B21B 27/10 62/373 |
| 2010/0024505 | A1 * | 2/2010 | Ueoka | C21D 9/46 72/202 |
| 2012/0031159 | A1 * | 2/2012 | Seidel | B21B 27/10 72/6.2 |
| 2013/0014553 | A1 * | 1/2013 | Nikkuni | B21B 28/04 72/8.5 |
| 2014/0290325 | A1 * | 10/2014 | Fischer | B21B 13/00 72/201 |

FOREIGN PATENT DOCUMENTS

| | | | | |
|---|---|---|---|---|
| EP | 0899030 | B1 | 3/1999 | |
| EP | 2620234 | A1 | 7/2013 | |
| JP | 61176411 | A | 8/1986 | |
| JP | S61295326 | A | 12/1986 | |
| JP | H06339712 | A * | 12/1994 | B21B 27/10 |
| JP | H06339712 | A | 12/1994 | |
| JP | 2010274301 | A | 12/2010 | |
| JP | 6015313 | A | 4/2014 | |
| KR | 2004092252 | A | 11/2004 | |
| KR | 2011098048 | A | 9/2011 | |
| KR | 2014006654 | A | 1/2014 | |

* cited by examiner

DEVICE AND METHOD FOR APPLYING A LIQUID MEDIUM TO A ROLL AND/OR TO A ROLLED MATERIAL AND/OR FOR REMOVING THE LIQUID MEDIUM

CROSS-REFERENCE TO RELATED APPLICATIONS

The present application is a 371 of International application PCT/EP2017/071157, filed Aug. 22, 2017, which claims priority of DE 10 2016 216 865.7, filed Sep. 6, 2016, and DE 10 2016 223 131.6, filed Nov. 23, 2016, the priority of these applications is hereby claimed and these applications are incorporated herein by reference.

BACKGROUND OF THE INVENTION

The invention relates to a device for applying a liquid medium to a roll, in particular to a work roll of a roll stand, and/or to a rolled material, a slab or a rough strip, and/or for removing the liquid medium, wherein the device has at least one spray nozzle, at least one row of spray nozzles, or at least one cooling bar for spraying the medium, and at least one plate element which is configured for collecting the medium, wherein the roll is configured for rolling rolled material, wherein the rolled material, the slab, or the rough strip, is conveyed in a conveying direction, wherein the plate element has at least one guide element on one of its surfaces, which guide element is configured for deflecting medium in a transverse direction that is horizontal and transverse to the conveying direction. The invention furthermore relates to a method for applying a liquid medium and/or for removing the liquid medium.

The requirements in terms of the efficiency of cooling work rolls are ever increasing. In order for the efficiency to be increased, ever larger work-roll cooling media flow rates, or cooling water flow rates, are therefore installed. However, limits caused by the stagnant water on the wiper plate are set in the case of the upper work roll. The water at the top can typically not run off as fast as it is applied. A pool of water is thus formed on the upper wiper plate, in particular in the case of wide rolling mills for large plates or strip widths to be rolled. The cooling effect is hampered when the cooling water sprays into said backed-up pool of water.

Water, and emulsion, a dispersion, oil, kerosene, or other media can be used as the cooling medium. For simplification, in most instances water is referred to as said cooling medium.

A device of the above mentioned type is known from JP H06 339712A. Here is found a channel on a plate element, which channel runs horizontal and transverse to the conveying direction so that the built up cooling water can be guided away to the side.

In order for the draining of the water to be facilitated, a type of drainage is disposed in JP 61176411 A such that the water can run-off into the region behind the spray pipes. Furthermore, a drainage duct which runs transversely at 90° above the wiper is provided for the upper roll cooling in JP 06339712 A, the water being able to run into said drainage duct and drain therefrom laterally. On account thereof, the upper roll cooling is to be improved in the center, or be homogenized across the width, respectively. A more complex technology is disclosed in EP 0 899 030 B1. Here, active suctioning of the water from the region above the upper wiper plate is shown.

All previously known solutions are not particularly efficient, interfere with the unimpeded discharge of water, or are very complex, respectively.

SUMMARY OF THE INVENTION

The invention is therefore based on the object of achieving an improvement in the cooling effect, in particular of the upper work roll cooling and preferably in the case of wide hot strip mills having a high specific water flow rate. Furthermore, an improved discharge of the descaling water is to be enabled when descaling a slab or a strip, respectively. Improved drainage conditions for the cooling medium of the upper work roll cooling are thus to be enabled, this to be established by avoiding the so-called pool effect, that is to say the back-up of the cooling medium above the wiper plate and/or a dissimilar cooling medium level across the wiper plate width (higher in the center). The same applies in analogous manner to the case of the descaling of a slab or a strip.

The achievement of said object by way of the invention is characterized in that the at least one guide element is configured so as to be planar and is disposed on the plate element at an angle in relation to the transverse direction, wherein the angle is between 5° and 80°, or that the at least one guide element is configured so as to be bent.

The at least one spray nozzle preferably delivers the medium onto the roll by way of a predefined central direction, wherein the tangent that points in the circumferential direction of the roll, at the location where the central direction meets the roll, in relation to the central direction has an angle which is larger than 90°.

According to one further embodiment of the invention, a plurality of spray nozzles and/or cooling bars which are disposed vertically on top of one another are disposed, wherein the plate element is disposed between two of or below said spray nozzles and/or cooling bars.

It can also be provided that a plurality of guide elements are disposed on the plate element, wherein the angle of said guide elements decreases in particular as the spacing from the roll, from the cooling bar, or from a descaling bar, increases.

The at least one guide element can also be configured so as to be bent. It can also be provided that the at least one guide element is disposed so as to be perpendicular, or inclined or twisted about the longitudinal axis thereof in the direction of the plate element.

It can also be provided that a plurality of guide elements are disposed on the plate element, wherein said guide elements are disposed on the plate element so as to be symmetrical or asymmetrical in relation to a vertically running central plane.

It can also be provided that a plurality of guide elements are disposed on the plate element, wherein said guide elements in terms of the vertical height thereof are dissimilar.

Means for transverse spraying can furthermore be disposed on the plate element,

The plate element in relation to the horizontal is preferably disposed at an angle which is between 1° and 45°, preferably between 1° and 20°.

The invention relates to a method for applying a liquid medium to a roll, in particular to a work roll of a roll stand, and/or to a rolled material, a slab or a rough strip, for example, and/or for removing the liquid medium. To this end, a device according to the invention is configured having at least one spray nozzle, at least one row of spray nozzles, or at least one cooling bar, for spraying the medium, and having at least one plate element which is configured for collecting the medium. The invention provides that the plate element on one of the surfaces thereof is provided with at least one guide element which is configured for deflecting medium to a transverse direction which lies so as to be horizontal and transverse in relation to the conveying direction, wherein the flow movement (that is to say the flow rate) of the applied liquid medium is utilized for diverting the liquid medium by means of the at least one guide element to the transverse direction, while the at least one guide element is level and arranged on the plate element at an angle to the transverse direction, wherein the angle is between 5° and 80°, or the at least one guide element is configured to be bent.

All design embodiment features of the device proposed above can be advantageously used in the method mentioned.

The invention is preferably used in a heavy plate mill stand, in a Steckel stand, in a hot strip mill, or in a CSP/USP plant.

BRIEF DESCRIPTION OF THE DRAWING

Exemplary embodiments of the invention are illustrated in the drawing in which.

DETAILED DESCRIPTION OF THE INVENTION

Figure 1:
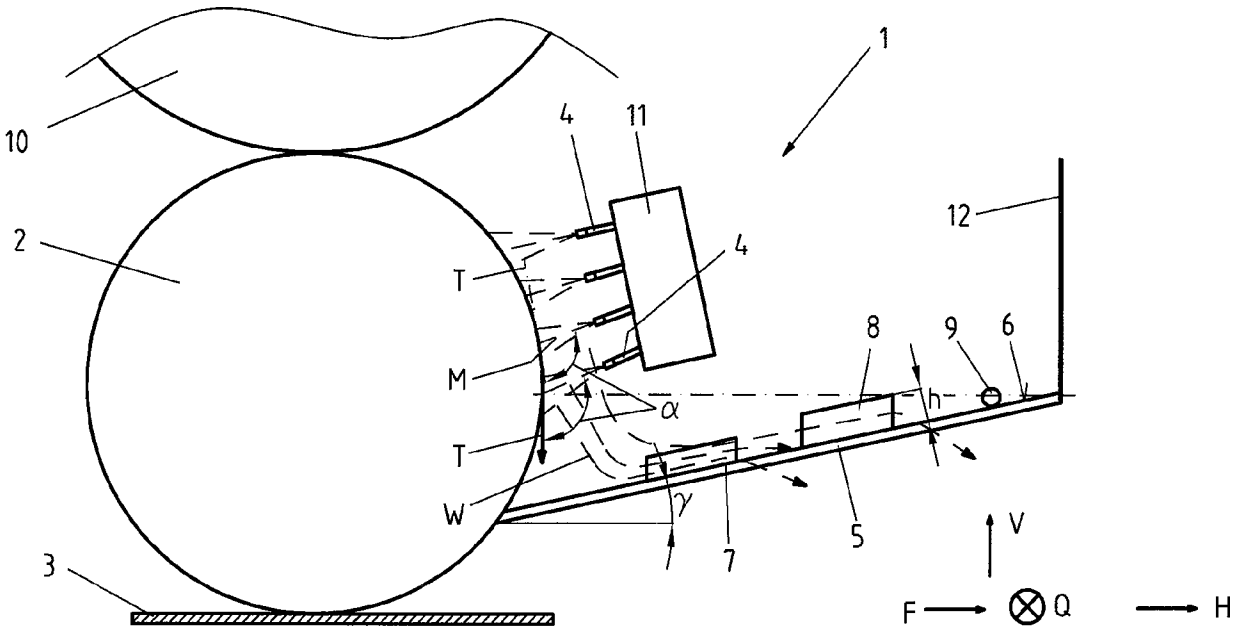
FIG. 1 schematically shows the side view of a device for applying water to the work roll of a roll stand and the removal of the water according to a first embodiment of the invention.
Figure 2:
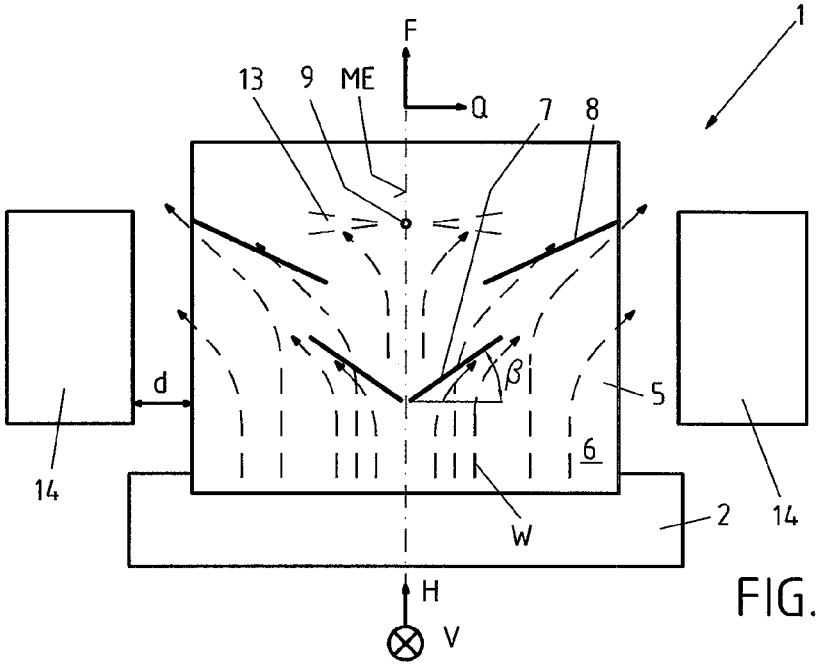
FIG. 2 schematically shows a plan view of the device associated with FIG. 1.

The side view, or plan view, respectively, of a device 1 for applying water W to the work roll 2 of a roll stand as well as for removing the water W is schematically drawn in FIG. 1 and FIG. 2. The work roll 2 is supported by a support roll 10. The work roll 2 rolls a rolled material 3 which is moved in a conveying direction F. The conveying direction F corresponds to the direction of the horizontal H.

The device 1 comprises a plurality of spray nozzles 4 which are disposed in a water cooling bar 11. Water W is sprayed onto the surface of the work roll 2 by way of the spray nozzles 4. A plate element 5 (wiper plate) which in relation to the horizontal H is inclined at an angle $\gamma$ is provided for discharging the sprayed water and for the purpose of avoiding that water flows in an unimpeded manner onto the strip. Guide elements 7 and 8 which enable that the water W is discharged from the plate element 5 toward the side in a transverse direction Q which is horizontal and perpendicular in relation to the conveying direction F are disposed (in particular welded) on the upper surface 6 of the plate element 5.

As can be derived from FIG. 2, the guide elements 7 and 8 in the exemplary embodiment described are offset in the conveying direction F, but are disposed so as to be symmetrical in relation to a vertically running central plane ME. The guide elements 7, 8 are configured in a straight manner and are disposed at an angle $\beta$ in relation to the transverse direction Q.

As can be seen from FIG. 1, the water jet by the spray nozzles 4 is sprayed onto the surface of the work roll 2 in a central direction M. The tangent T, which points in the circumferential direction of the work roll 2 and on the surface of the work roll 2 results at the location where the central direction M meets the work roll 2, in relation to the central direction M lies at an angle $\alpha$ which is preferably larger than 90°.

Means 9 for transverse spraying are furthermore disposed on the plate element 5.

It can also be seen from FIG. 1 that the guide elements 7, 8 can have dissimilar heights h.

The guide element 7, 8 can be composed of at least one long metal sheet which at the narrow side thereof is fastened to the plate element 5.

In order for a rapid discharge of the water W or another cooling medium to be enabled in the case of the upper work roll cooling, it is thus provided that the speed of the cooling water W flowing onto the work roll 2 is used per se, and the water flush to be deflected in a targeted manner to the rear and to the side. The illustrations as per FIG. 1 and FIG. 2 highlight the functioning and the arrangement of the optimized water discharge in the side view and in the plan view.

To this extent, FIG. 1 shows an upper work roll cooling on the outlet side. Water W from the roll cooling bar 11 exits predominantly from a plurality of rows of sprays and ultimately from the nozzles 4, and sprays onto the roll 2. At least one row of sprays is disposed such that the water flow is inclined in the direction of the plate element 5 (wiper plate). That is to say that the angle of attack $\alpha$ between the center of the water jet M and the tangent T to the roll surface is larger than 90°, such can be seen in FIG. 1 for the lower rows of sprays.

A targeted water flow initially along the roll 2 and by way of minor deflection losses toward the rear is established on account of this advantageous alignment. The water flowing toward the rear (in the rolling direction) has now to be deflected toward the side in an ideally continuous manner. As has been described, this takes place by way of deflection plates (guide elements 7, 8) on the plate element 5 (wiper plate), said deflection plates being disposed at the angle of attack $\beta$ of more than 5° (cf. FIG. 2 where the water-flow deflection principle is illustrated). The plate element 5 in the conveying direction F is terminated by rear wall 12, as is shown in FIG. 1.

In the case of conventional roll cooling, the water flows only toward the rear against a rear wall, is backed-up there, wherein a lateral water drainage takes place on account of the backed-up water level. In the case of some solutions (cf. JP 06339712 A mentioned at the outset, for example) the water flush toward the rear is decelerated by a drainage. In the case of the solution proposed according to the invention, the water W runs along the guide elements 7, 8 (deflection plates) set at an angle, and is largely deflected toward the side, thus in the transverse direction Q.

Ideally, no interfering edges (excluding unavoidable fastenings, bearings, screw-fittings, etc.) which disturb, impede, or decelerate the water flow away from the roll, or from the impingement location, respectively, toward the rear or toward the side are disposed above the plate element.

Four deflection plates 7, 8 are in each case disposed in a staggered manner behind one another in the exemplary embodiment according to FIGS. 1 and 2, said deflection plates 7, 8 deflecting the water W in a substantially symmetrical manner toward the sides. In general, at least one guide element (deflection plate) is required for the desired deflection effect. The water can then drain downward (for example into a sinter trough) at the lateral ends of the plate element 5 (wiper plate).

The spacing d between the plate element 5 (wiper plate) and the laterally delimiting environment, such as the roll stand 14, installation pieces, bending blocks, or entry or exit guide frames, should be dimensioned so as to be as large as possible (preferably larger than 50 mm). Impediments by way of delimiting lateral faces can be avoided by providing drainage bores, preferably in the region of the water flows. A dripping edge, or a breakoff edge, respectively, (in a manner similar to a window ledge) is advantageously provided on the lateral faces below the wiper (that is to say of the plate element 5), or a channel in the lower side at the edge of the plate element 5 is provided such that water does not run inwards onto the edge of a wide strip or onto the plate. Optionally, a transverse spray 13 which pushes the roll cooling water toward the outside, as is indicated in FIG. 2, is additionally provided for removing the residual water in the rear region of the wiper. The means 9 are provided for this purpose.

The plate element 5, or regions thereof, on the upper side can also be embodied so to have an inclination toward the side, so as to additionally improve drainage of the water.

Figure 3:
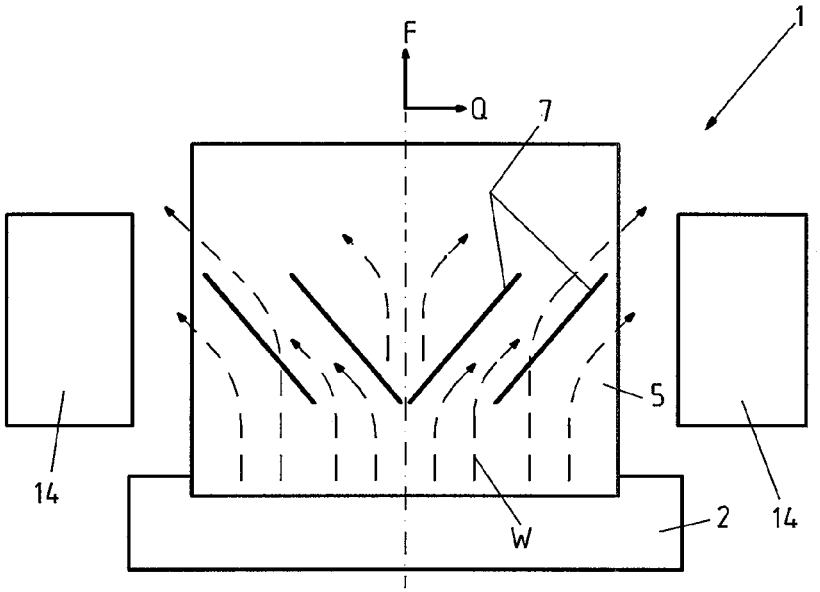
FIG. 3 schematically shows the plan view as per FIG. 2, according to a second embodiment of the invention.

The guide elements 7, 8 (deflection plates) can be of dissimilar heights (cf. height h which is preferably greater than 20 mm). The guide elements 7, 8 (deflection plates) herein can be disposed in a staggered manner behind one another, as is shown in FIG. 2, or else beside one another. The latter solution is shown in FIG. 3. By contrast to the solution according to FIG. 2, it is moreover provided here that all of the guide elements 7, when viewed in the transverse direction Q, are situated at one position.

Figure 4:
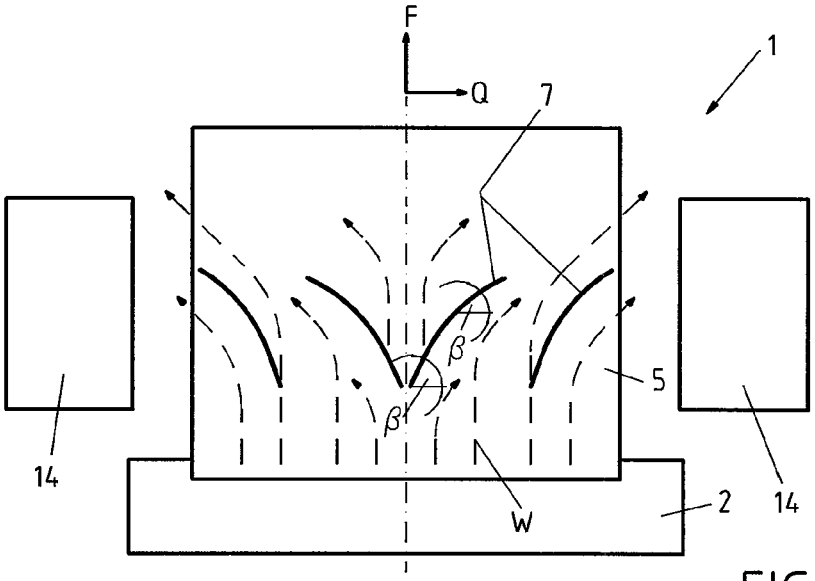
FIG. 4 schematically shows the plan view as per FIG. 2, according to a third embodiment of the invention.

An advantageously curved or bent, respectively, configuration of the guide elements 7 (water deflection plates) is also possible, as can be seen from the illustration according to FIG. 4. The shape of the guide elements 7 here is similar to the shape of a turbine blade or of a plough, the angle β in relation to the transverse direction Q here continuously varying across the extent of the guide element.

A variation of the inclination of the guide element 7 across the extent of the latter, precisely in the manner of a turbine blade, is also possible and considered for optimizing the flow conditions. The guide elements 7, 8 (deflection plates) can thus be embodied so as to be aligned perpendicularly in the direction of the plate element 5 (wiper plate) or so as to be somewhat inclined or twisted about the longitudinal axis.

Figure 5:
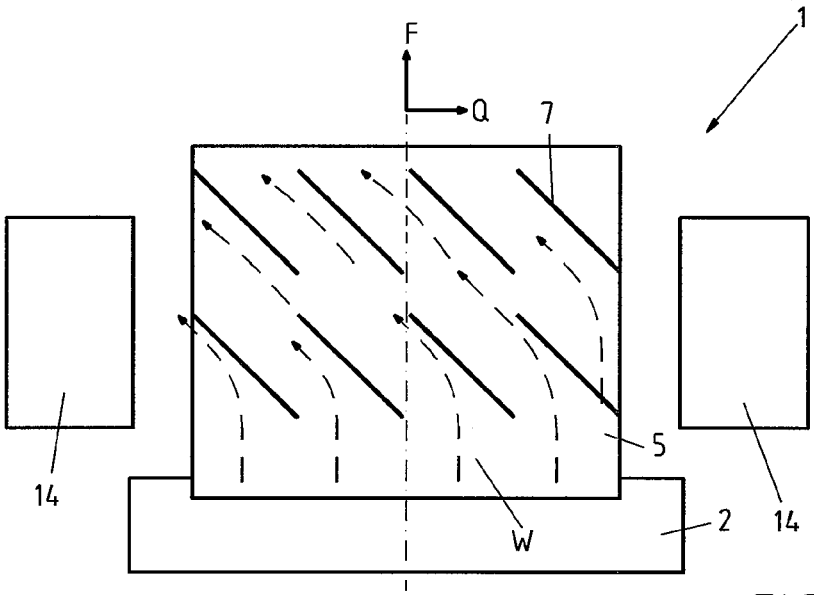
FIG. 5 schematically shows the plan view as per FIG. 2, according to a fourth embodiment of the invention.

While a symmetrical deflection of the water jet in the transverse direction Q toward both sides of the plate element 5 is typically advantageous, another design embodiment can also be provided. In certain cases it can be advantageous for the guide elements 7, 8 to be aligned only in one direction. FIG. 5 shows such an exemplary embodiment. It can thus be achieved that the water W (or any other cooling medium, of course) is concentrated on one drainage side.

Figure 6:
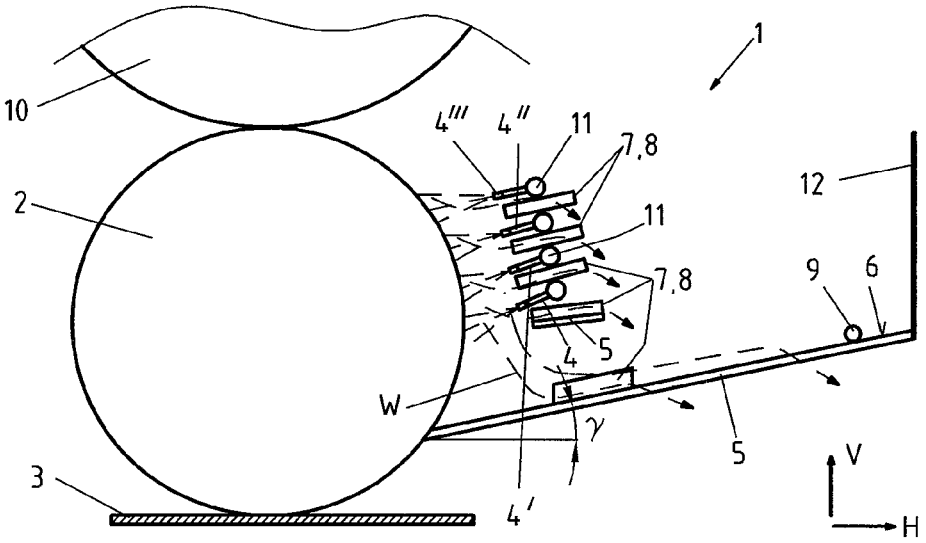
FIG. 6 schematically shows the side view of a device for applying water to the work roll of a roll stand and for removing the water, according to a fifth embodiment of the invention.
Figure 7:
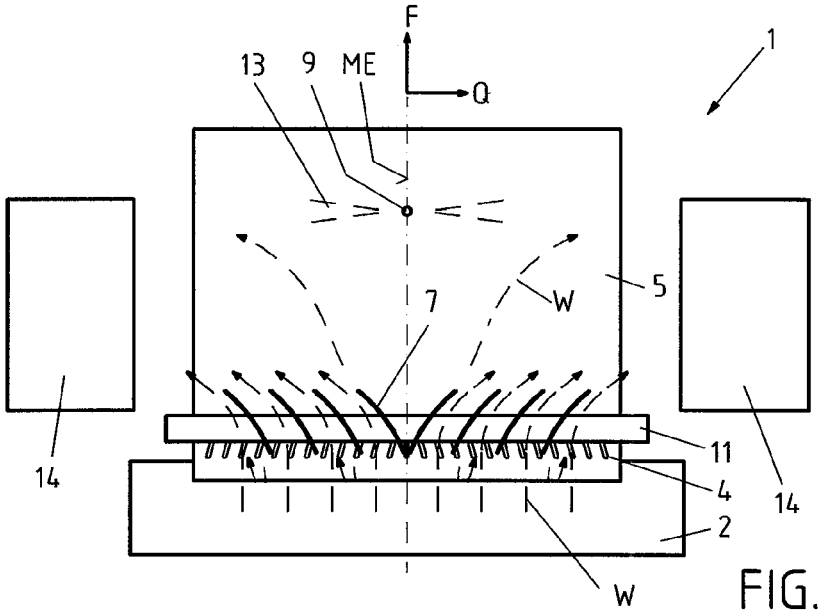
FIG. 7 schematically shows the plan view of the device associated with FIG. 6.

In the case of one further embodiment of the invention, guide elements 7, 8 (deflection plates) are not only provided on the plate element 5 which functions, for example, as a wiper or as a water/strip separation plate, as has been the case in the exemplary embodiments described so far. Guide elements 7, 8 without plate elements or on plate elements 5, which are assembled between and/or above and/or under the cooling bars 11 so as to deflect the returning water flow toward the side already at an early stage, can also be provided. The exemplary embodiment as per FIGS. 6 and 7 shows such a solution. Four water cooling bars 11 which are disposed on top of one another and which support respective rows of spray nozzles 4, 4', 4", 4''' are provided herein according to FIG. 6.

In order for the various water flows to be separated, plate elements 5 which are disposed so as to be horizontal (with or without an inclination toward the rear) can also be disposed above the wiper or the water/strip separation plate (that is to say the lowermost plate element 5 in FIG. 6 which terminates close to the work roller 2), respectively, the guide elements 7, 8 (deflection plates) being fastened to said plate element 5. An example thereof is schematically illustrated below the lowermost water cooling bar 11 in FIG. 6.

In order for the flow conditions toward the sides to be facilitated, the nozzle feed pipes or the nozzles 4, 4', 4', 4''' can furthermore be aligned so as to be somewhat oblique in relation to the central plane MF The water in this instance at a small angle sprays out toward the side as can be seen in the plan view in FIG. 7.

The guide elements 7, 8 can be embodied as deflection plates but can however also be designed in another manner (for example as plates which may be composed of different materials), as long as said guide elements 7, 8 fulfill the desired task, specifically effect the deflection of the water jet, thus fulfill the cooling-medium deflection principle.

In the case of the concept proposed, a specific water flow rate of more than 40 $m^3$ per hour and per meter of width is preferably used as the typical water flow rate for the upper roll cooling.

The angle of attack γ in relation to the horizontal for the upper plate element 5 (wiper plate) of the work roller cooling should be smaller than 45° so that the water does not have to excessively run upward.

Figure 8:
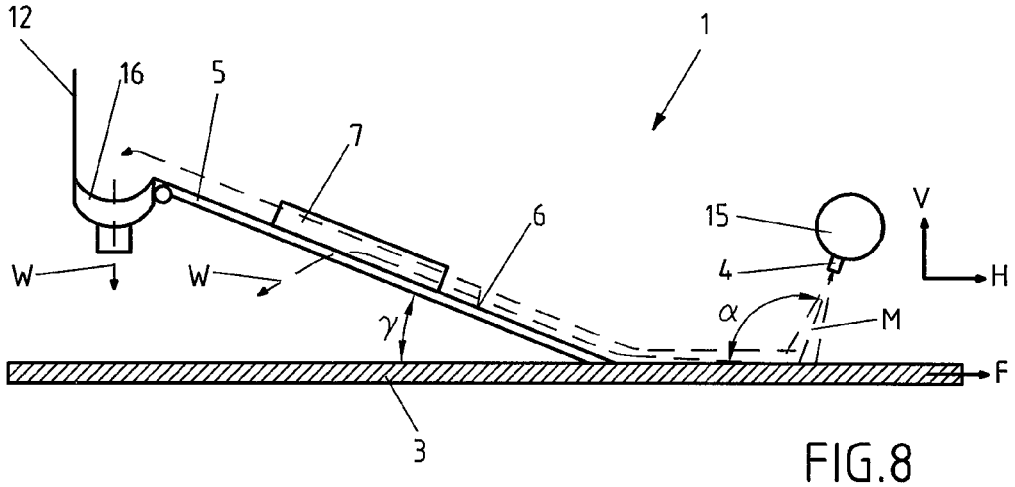
FIG. 8 schematically shows the side view of a device for applying water to a slab for the purpose of descaling the latter, as well as for removing the water.
Figure 9:
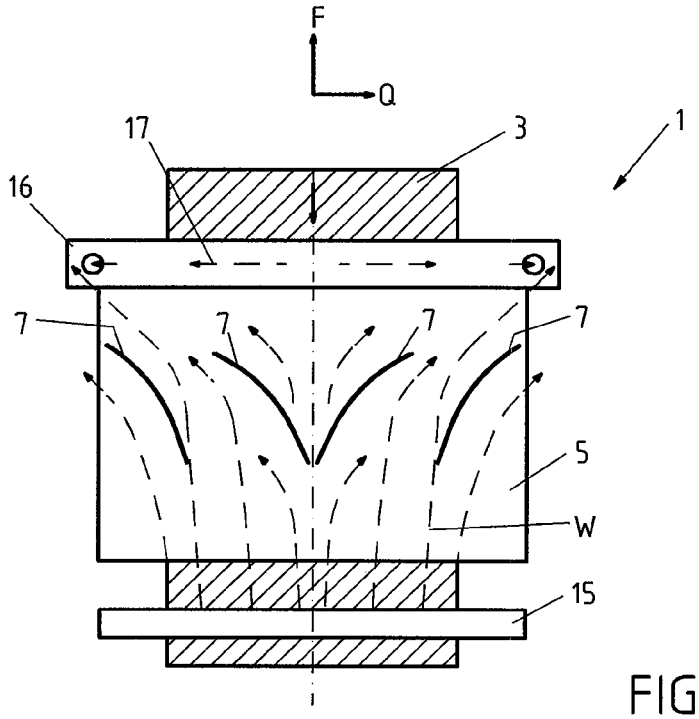
FIG. 9 schematically shows the plan view of the device associated with FIG. 8.

Not only can the drainage conditions of the work-roll cooling water be improved by way of the proposed concept, but an improved discharge of descaling water (including scale particles) toward the side, thus in the transverse direction Q, in the case of a descaling or another strip or plate cooling installation for the upper side is also possible, as is shown by the exemplary embodiment as per FIGS. 8 and 9, when a descaling is illustrated in which the device 1 is used.

It can be seen from FIG. 8 that the plate element 5, here configured as a water drainage plate, scrapes on the moving slab, plate, or the rough strip 3. Said plate element 5 by way of the deadweight thereof bears on the rolled material so as to move in manner of a pendulum. The plate element 5 (water drainage plate) can also be kept at a defined spacing from the slab 3 (without contact with the rolled material).

In the case of the descaling, the descaling water W for the descaling is initially sprayed onto the slab 3 by means of the descaling bar 15, the water W running, counter to the movement direction (conveying direction F) of the slab 3, up the plate element 5. The guide elements 7, as can be seen in the side view in FIG. 8 and in the plan view in FIG. 9, are again situated on the plate element. Various arrangements and design embodiments of the guide elements are also possible here. Most of the water drains in a lateral manner. The residual water is fed to a water catchment channel 16. This is facilitated by a gradient 17 in the water catchment channel 16.

The proposed device is advantageously used in particular in the case of wide rolling mills such as heavy plate mill stands, Steckel stands, or other wide hot strip mills.

It is to be explicitly stated that the design embodiment features described above can also be used in arbitrary combinations. This applies in particular to the design and arrangement of the guide elements 7, 8.

LIST OF REFERENCE SIGNS

1 Device for applying and removing water
2 Roll (work roll)
3 Rolled material/slab, plate, rough strip
4 Spray nozzle
4' Spray nozzle
4" Spray nozzle
4'" Spray nozzle
5 Plate element
6 Surface of the plate element
7 Guide element
8 Guide element
9 Means for transverse spraying
10 Support roll
11 Cooling bar (water cooling bar)
12 Rear wall
13 Transverse spraying
14 Roll stand
15 Resealing bar
16 Water catchment channel
17 Gradient in the channel
W Liquid medium (water)
F Conveying direction
Q Transverse direction
H Horizontal
V Vertical
M Central direction
ME Vertically running central direction
T Tangent
h Height
d Spacing
α Angle between the central direction and the tangent
β Angle in relation to the transverse direction
γ Angle of the plate element in relation to the horizontal

The invention claimed is:

1. A device for applying a liquid medium to a roll, a rolled material, a slab, or a rough strip conveyed in a conveying direction, and for removing the liquid medium, the device comprising: at least one spray nozzle for spraying the medium; at least one plate element configured for collecting the medium; and at least one guide element arranged on one surface of the plate element, the at least one guide element being configured to deflect the medium in a transverse direction that lies horizontal and transverse to the conveying direction, wherein the at least one guide element is planar and is disposed on the plate element at an angle in a plane of the plate element between 5° and 80° in relation to the transverse direction or the at least one guide element is configured so as to be curved.

2. The device according to claim 1, wherein the at least one spray nozzle is arranged to deliver the medium onto the roll in a predefined central direction, wherein a tangent that points in a circumferential direction of the roll, at a location where the central direction meets the roll, is at an angle to the central direction that is larger than 90°.

3. The device according to claim 1, wherein the at least one spray nozzle includes a plurality of spray nozzles disposed vertically on top of one another, wherein the plate element is disposed between two of or below said spray nozzles.

4. The device according to claim 3, wherein the at least one guide element is curved and includes a plurality of guide elements disposed on the plate element, wherein the angle of said guide elements decreases as a spacing from the roll, from the cooling bar, or from a descaling bar increases.

5. The device according to claim 1, wherein the at least one guide element is disposed so as to be perpendicular, inclined or twisted about a longitudinal axis of the guide element in a direction of the plate element.

6. The device according to claim 1, wherein the at least one guide element includes a plurality of guide elements disposed on the plate element, wherein said guide elements are disposed on the plate element so as to be symmetrical or asymmetrical to a vertically running central plane.

7. The device according to claim 1, wherein the at least one guide element includes a plurality of guide elements disposed on the plate element, wherein said guide elements are dissimilar in terms of vertical height.

8. The device according to claim 1, further comprising means for transverse spraying disposed on the plate element.

9. The device according to claim 1, wherein the plate element is arranged so as to be laterally spaced from a roll stand by more than 50 mm.

10. The device according to claim 1, wherein the plate element is disposed at an angle between 1° and 45° to horizontal.

11. The device according to claim 1, wherein the at least one nozzle includes at least one row of nozzles.

12. The device according to claim 1, wherein the at least one nozzle includes at least one cooling bar.

13. A method for applying a liquid medium to a roll, a rolled material, a slab, or a rough strip conveyed in a conveying direction, and for removing the liquid medium, the method comprising the steps of: spraying the medium onto the roll with at least one spray nozzle; and collecting the medium with at least one plate element, wherein at least one guide element is arranged on a surface of the plate element, the at least one guide element being configured to deflect the medium in a transverse direction that lies horizontal and transverse to the conveying direction, wherein the flow movement of the applied liquid medium diverts the liquid medium to the transverse direction by way of the at least one guide element, wherein the at least one guide element is planar and is disposed on the plate element at an angle in the plane of the plate element between 5° and 80° relative to the transverse direction, or the at least one guide element is configured to be curved.

* * * * *